United States Patent [19]

Watanabe

[11] Patent Number: 4,857,794

[45] Date of Patent: Aug. 15, 1989

[54] SINGLE-FILAMENT HEADLAMP UNIT CAPABLE OF THROWING BOTH UPPER AND LOWER BEAMS

[75] Inventor: Saburo Watanabe, Shizuoka, Japan

[73] Assignee: Koito Seisakusho Co., Ltd., Tokyo, Japan

[21] Appl. No.: 93,091

[22] Filed: Aug. 31, 1987

[30] Foreign Application Priority Data

Sep. 3, 1986 [JP] Japan ..... 61-208428
Jul. 11, 1987 [JP] Japan ..... 62-173698

[51] Int. Cl.[4] ..... H01K 1/30
[52] U.S. Cl. ..... 313/113; 362/61
[58] Field of Search ..... 362/61, 268, 280; 313/113; 315/82

[56] References Cited

U.S. PATENT DOCUMENTS

| | | | |
|---|---|---|---|
| 1,389,291 | 1/1921 | Bone | 362/280 |
| 1,660,699 | 7/1928 | Wood | 362/61 |
| 1,928,431 | 11/1933 | Morshead et al. | 362/268 |
| 4,432,040 | 2/1984 | Matsuura et al. | 362/61 |

*Primary Examiner*—Robert L. Griffin
*Assistant Examiner*—T. Salindong
*Attorney, Agent, or Firm*—Browdy and Neimark

[57] ABSTRACT

A lamp unit having a single-filament bulb disposed at a first focus of an ellipsoidal or like reflector which has a second focus disposed farther away therefrom than is the first focus. Disposed opposite the reflector, a converging lens has its focus in the vicinity of the second focus of the reflector. A lower beam shade is also disposed adjacent the second focus of the reflector for cutting off the rays that have been reflected from the bottom half of the reflector, so that the rays reflected from the top half of the reflector are allowed to impinge on the converging lens thereby to be thrown as a lower beam. In order to enable this lamp unit to emit an upper beam of optimum intensity distribution as well, the converging lens is made tiltable, or linearly movable, upwardly to an extent necessary to permit all the rays reflected by the reflector to fall on the converging lens. The shade may be displaced downwardly in step with the upward displacement of the lens.

7 Claims, 17 Drawing Sheets

SINGLE-FILAMENT HEADLAMP UNIT CAPABLE OF THROWING BOTH UPPER AND LOWER BEAMS

BACKGROUND OF THE INVENTION

1. Field of the Invention

My invention relates to electric lamps and pertains more specifically to those well suited for automotive headlamp and like lighting applications. Still more specifically, my invention concerns an electric lamp unit comprising a single-filament bulb in conjunction with facilities for selective production of upper and lower beams of optimal cross-sectional patterns and intensity distributions. By the "upper beam" I mean, of course, a beam intended primarily for distant illumination when the vehicle is not meeting or following other vehicles, and by the "lower beam" a beam for illuminating the road ahead of the vehicle when it is meeting or following another vehicle.

2. The Prior Art

Automtoive headlamp systems are classifiable into two categories according to the number of lamp units, that is, those employing two units and those employing four units. Some four-lamp systems incorporate lamp units that are devoted exclusively for the production of the lower beam. A familiar example of such lower beam lamp units employ a lower beam shade positioned intermediate an ellipsoidal reflector and a converging lens. The ellipsoidal reflector has a first focus at which a bulb is disposed, and a second focus spaced farther away from the reflector than is the first focus. Disposed close to the second focus of the reflector, the shade functions to cut off the rays that have been reflected from the lower half of the reflector and which, consequently, are angled upwardly. Only the rays that have been reflected from the upper half of the reflector are allowed to bypass the shade and to impinge on the converging lens, thereby to be projected as the lower beam.

My evaluation of this known lower beam lamp unit as such is very favorable by reason of the good beam pattern obtainable with the provision of the shade only, which is simple in construction and easy of manufacture and mounting. As an additional advantage, the contoured edge of the shade provides a clearcut upper edge of the lower beam pattern and so effectively protects the drivers of the oncoming vehicles from glare.

Offsetting all these advantages, however, is the fact the lower beam lamp unit as so far constructed has lent itself to use only as such, namely, only as a unit of a four-unit headlamp system. The utility of this type of lamp unit will certainly be enhanced if it is switchable to provide both upper and lower beams, so that the lamp unit may find use in two-lamp systems as well.

I have contemplated the adaptation of the lower beam lamp unit for both upper and lower beam production by making the shade movable vertically relative to the reflector and the converging lens. The shade might be so moved between an upper working position, in which it cuts off the rays reflected from the lower half of the reflector, and a lower retracted position where the shade permits all the reflected rays to travel therepast. Not only the pattern of the lower beam produced when the shade is in the working position, but also that of the upper beam emitted when the shade is in the retraction position, would be of acceptable outline.

A problem arises, however, because of the unvaried vertical position of the "hot zone" (i.e. region of maximum light intensity) of the upper and lower beam patterns so produced. Generally, the hot zone of the upper beam must be located on the horizontal axis passing the center of the lamp unit, whereas the hot zone of the lower beam must be below the horizontal axis. If the above suggested adaptation of the known lower beam lamp unit is so optically configured that the hot zone of the lower beam is below the horizontal axis, the hot zone of the upper beam will be too low, being at the same height as that of the lower beam. Conversely, if the optical configuration is such that the hot zone of the upper beam is on the horizontal axis, then the hot zone of the lower beam will be too high.

SUMMARY OF THE INVENTION

I have hereby discovered how to adapt the above stated type of known lower beam lamp unit for the projection of both upper and lower beams of optimal patterns and hot zone locations.

Briefly, my invention may be summarized as an electric lamp unit for particular use as a vehicular headlamp capable of selective production of upper and lower beams. The lamp unit comprises a reflector having an optical axis extending horizontally, a first focus, and a second focus disposed farther away from the reflector than is the first focus. A light source such as a incandescent single-filament lamp is disposed at the first focus of the reflector, so that the reflector reflects rays of light from the source so as to converge at its second focus. A lower-beam shade is disposed adjacent the second focus of the reflector. Also included is a converging lens disposed opposite the reflector and having a focus in the vicinity of the second focus of the reflector. My invention particularly features means for selectively moving the converging lens relative to the reflector between a "lower beam" position, in which the optical axis of the converging lens is aligned with the optical axis of the reflector and in which the shade permits the rays that have been reflected only from approximately an upper half of the reflector, to impinge on the converging lens, and an "upper beam" position which is displaced upwardly from the "lower beam" position and in which the shade permits substantially all the rays that have been reflected from the reflector, to impinge on the converging lens.

When the converging lens is in the "lower beam" position, with its axis in alignment with that of the reflector, the lower-beam shade functions as in the prior art to cut off the rays that have been reflected from approximately the bottom half of the reflector. On the other hand, the rays that have been reflected from the top half of the reflector are allowed to fall on the lens and are thereby projected forwardly as a lower beam having its hot zone located below the horizontal plane passing the center of the lamp unit. Upon upward displacement of the converging lens to the "upper beam" position, substantially all the rays that have been reflected by the reflector can fall on the lens even if the shade lies in the same position as when the lens is in the "lower beam" position. The resulting upper beam has its hot zone displaced upwardly from the hot zone of the lower beam because of the upward displacement of the lens.

Preferably, the lower-beam shade may be held close to the the second focus of the reflector only when the converging lens is in the "lower beam" position, and may be moved downwardly upon upward displacement of the lens to the "upper beam" position, in order that a greater proportion of the rays reflected by the reflector may fall on the lens in the "upper beam" position. In one embodiment of my invention, therefore, a lens frame rigidly supports both the lens and the shade. The lens frame is pivotable relative to the reflector about a horizontal axis which is at right angles with the reflector axis, as seen vertically, and which is disposed intermediate the lens and the shade. Accordingly, when the lens frame is pivoted for raising the lens from the "lower beam" to "upper beam" position, the shade is lowered away from the adjacency of the second focus of the reflector. Such angular displacement of the lens frame is preferred because a common drive mechanism can be employed for oppositely moving the lens and the shade.

The above and other features and advantages of my invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
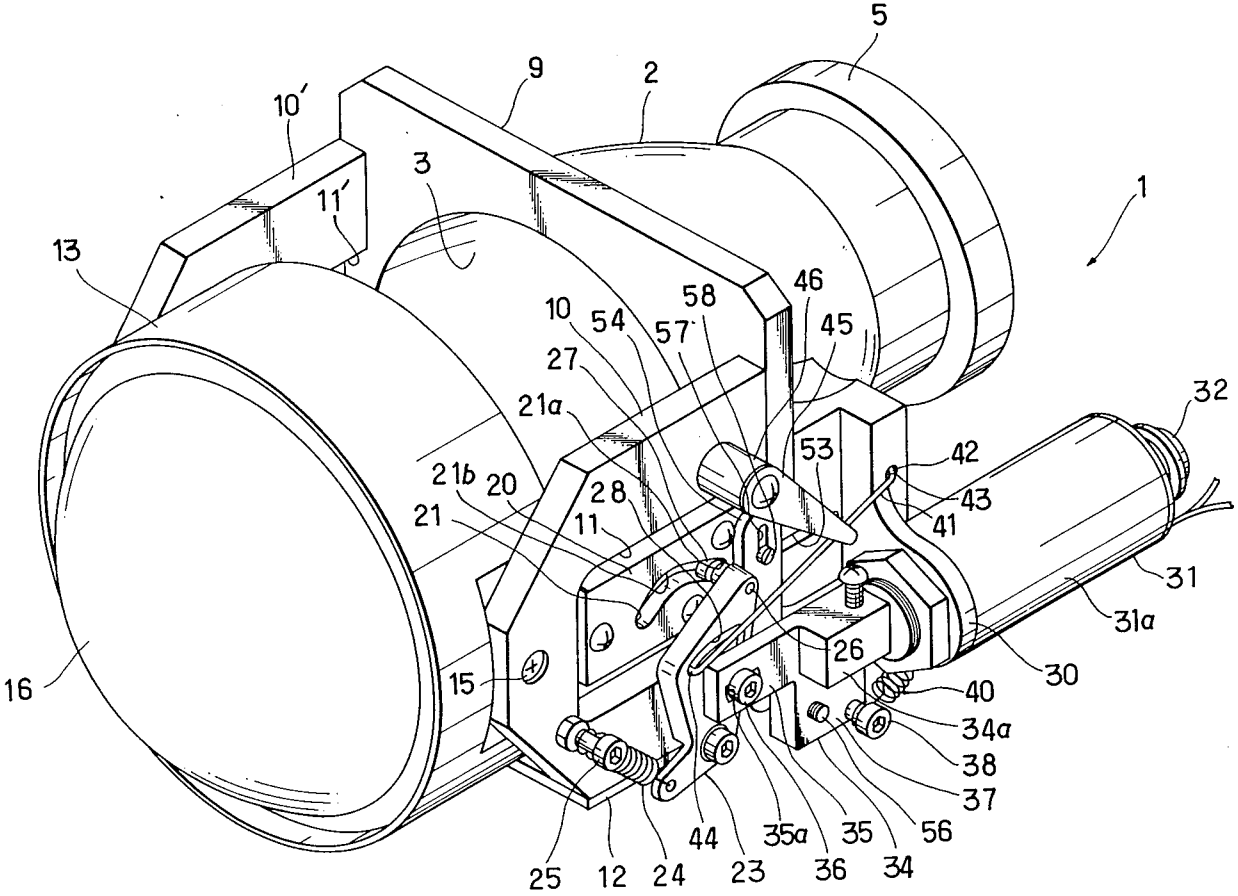
FIG. 1 is a perspective view of the vehicular headlamp unit embodying the principles of my invention.

I will now describe my invention as embodied in an automotive headlamp unit shown in its entirety in FIGS. 1–8 and therein generally designated 1. As seen in all but FIG. 5 of these drawings, the headlamp unit 1 has a reflector 2 typically in the form of an aluminum die casting. The refelector 2 has a reflective surface 3, FIGS. 1 and 2, which is shaped like an ellipsoid of revolution. Mounted to the back, shown directed to the right in FIGS. 1–3, of the reflector 2 is a disklike bulb mount 5 having an opening 4 defined centrally therethrough for firmly but removably supporting a single-filament bulb 6 herein shown as a familiar halogen-cycle incandescent bulb. FIG. 1 indicates that the bulb 6 has an envelope 7 of vitreous material containing a filament **6*a* and having its front end portion covered with a shield coating 8 to cut off the rays that are not directed toward the reflective surface 3**.

The bulb 6 carried by the bulb mount 5 is mounted to the reflector 2 by being inserted in and through its rear opening, not shown, which is closed by the bulb mount as the latter is fastened to the reflector. So mounted to the reflector 2, the bulb 6 has its filament **6*a*** disposed at a first focus of the reflector, as will be detailed presently.

The reflector 2 has a flange 9 of square shape formed around its front end. Extending forwardly from the flange 9 are a pair of parallel lugs 10 and 10' which are horizontally spaced from each other and which have defined therein openings 11 and 11' of rectangular shape elongated in the front-to-rear depth direction of the headlamp unit 1. A reinforcing plate 12 joins the bottom edges of the lugs 10 and 10'.

Figure 7:
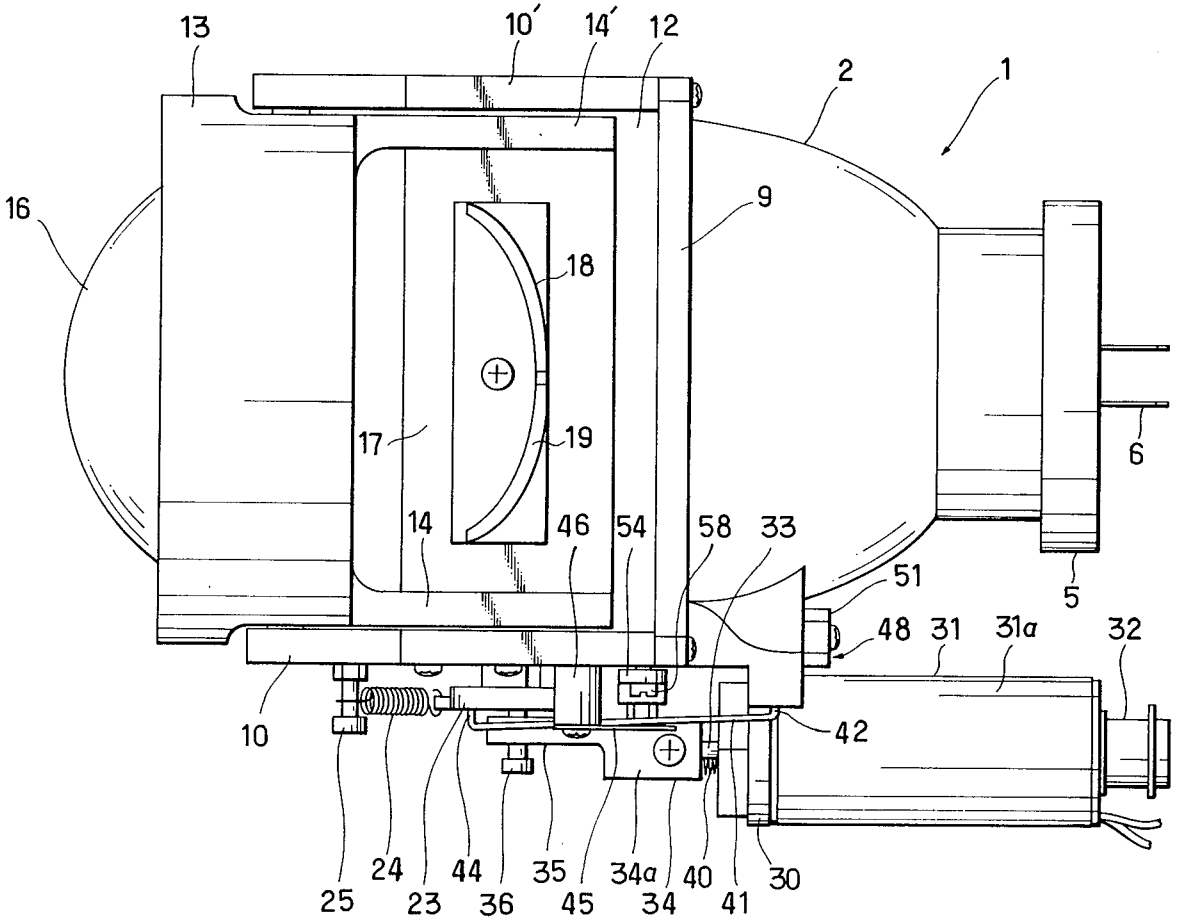
FIG. 7 is a top plan of the headlamp unit.
Figure 8:
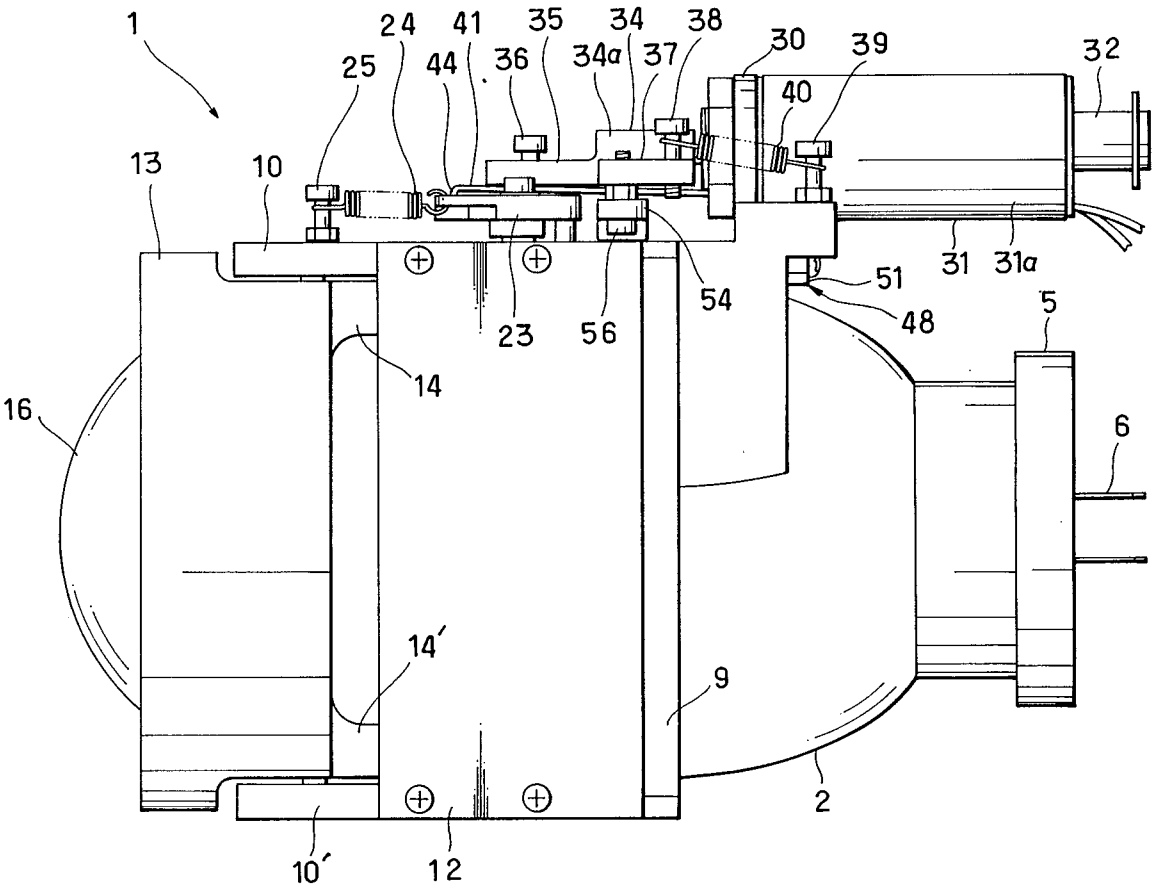
FIG. 8 is a bottom plan of the headlamp unit.

A tubular lens frame 13, rigidly holding a converging lens 16, is supported by the pair of lugs 10 and 10' via trunnions 15 and 15' for pivotal motion about the aligned horizontal axis of the trunnions which is at right angles with the optical axis of the headlamp unit 1. It is to be noted that the converging lens 16 is somewhat displaced forwardly of the aligned axis of the trunnions 15 and 15'. The lens frame 13 also has a pair of lugs 14 and 14' formed in diametrically opposed positions thereon and extending rearwardly therefrom in parallel spaced relation to each other. I will refer to these lugs 14 and 14' as the lens lugs in contradistinction from the lugs 10 and 10', which, then, I will call the reflector lugs. As best depicted in FIG. 7, the lens lugs 14 and 14' are disposed between, and parallel to, the reflector lugs 10 and 10' so as to be exposed laterally through the rectangular openings 11 and 11' in the latter.

Extending between the bottom edges of the lens lugs 14 and 14' in overlying relation to the reinforcing plate 12 is a shade support plate 17 having fixedly mounted thereon a lower-beam shade 18 disposed intermediate the reflector 2 and the lens 16. The shade 18 has a contoured top edge 19 for cutting off the rays from the bulb filament **6*a* for optimum lower beam distribution, as will be later explained in more detail. As seen in a plan view as in FIG. 7, the shade 18 is curved in conformity with the horizontal sectional shape of the image surface of the converging lens 16**.

It will have been seen from the foregoing that the converging lens 16 together with the lens frame 13 and lower-beam shade 18 is pivotable within limits about the horizontal axis of the trunnions 15 and 15' relative to the reflector 2 and bulb 6 for selective upper- and lower-beam projection. I will now discuss the means employed in this particular embodiment for such pivotal displacement of the lens 16 and shade 18.

Figure 3:
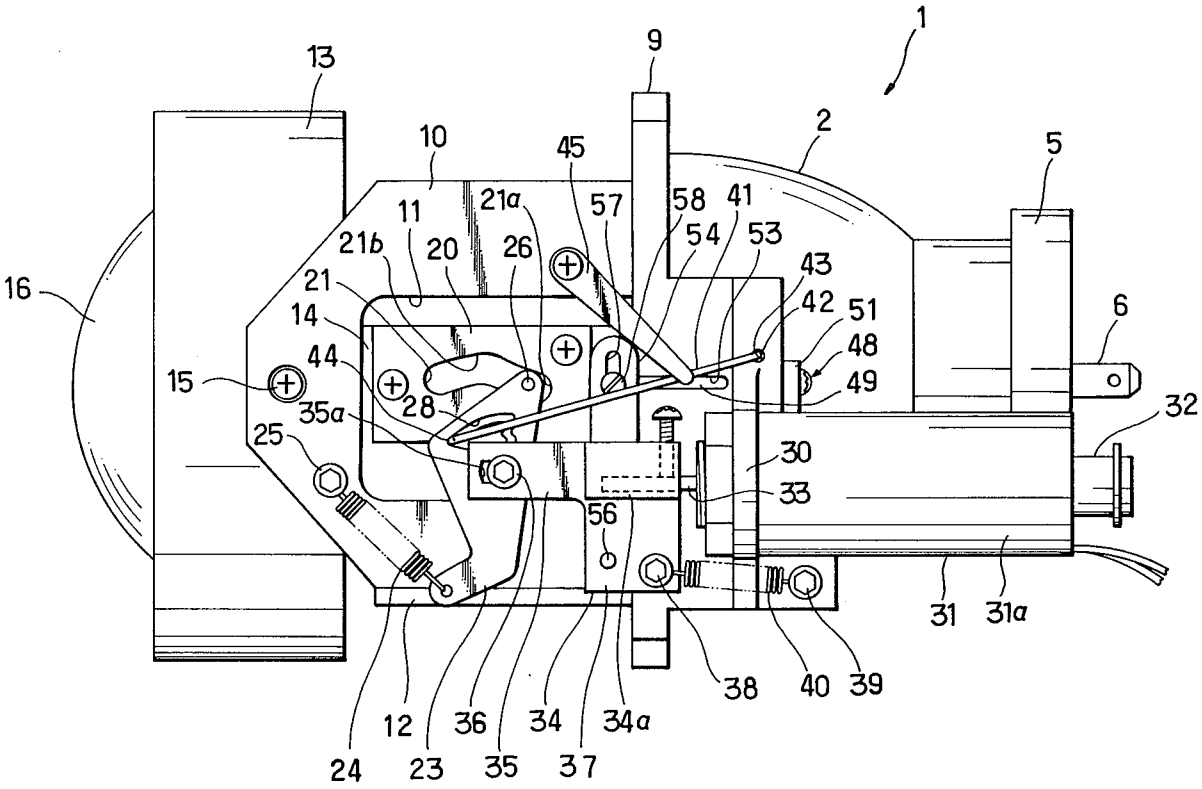
FIG. 3 is a right hand side elevation of the headlamp unit as seen in FIG. 1.
Figure 4:
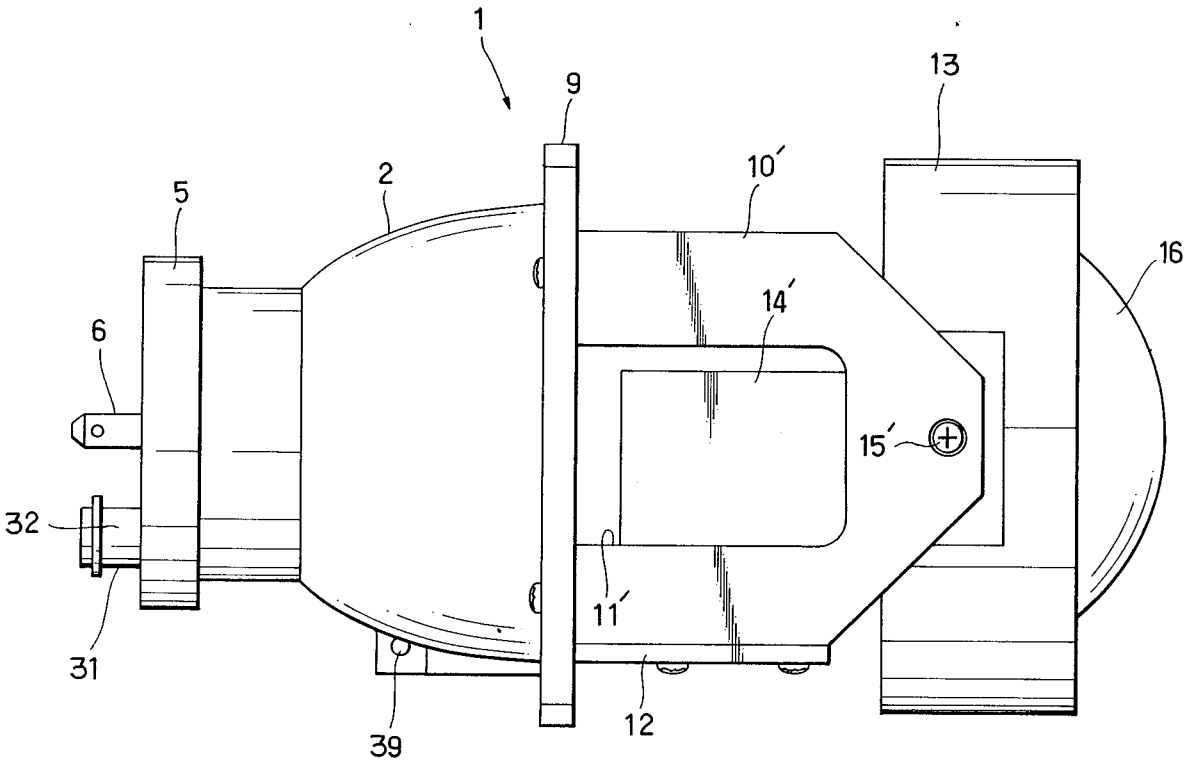
FIG. 4 is a left hand side elevation of the headlamp unit as seen in FIG. 1.
Figure 5:
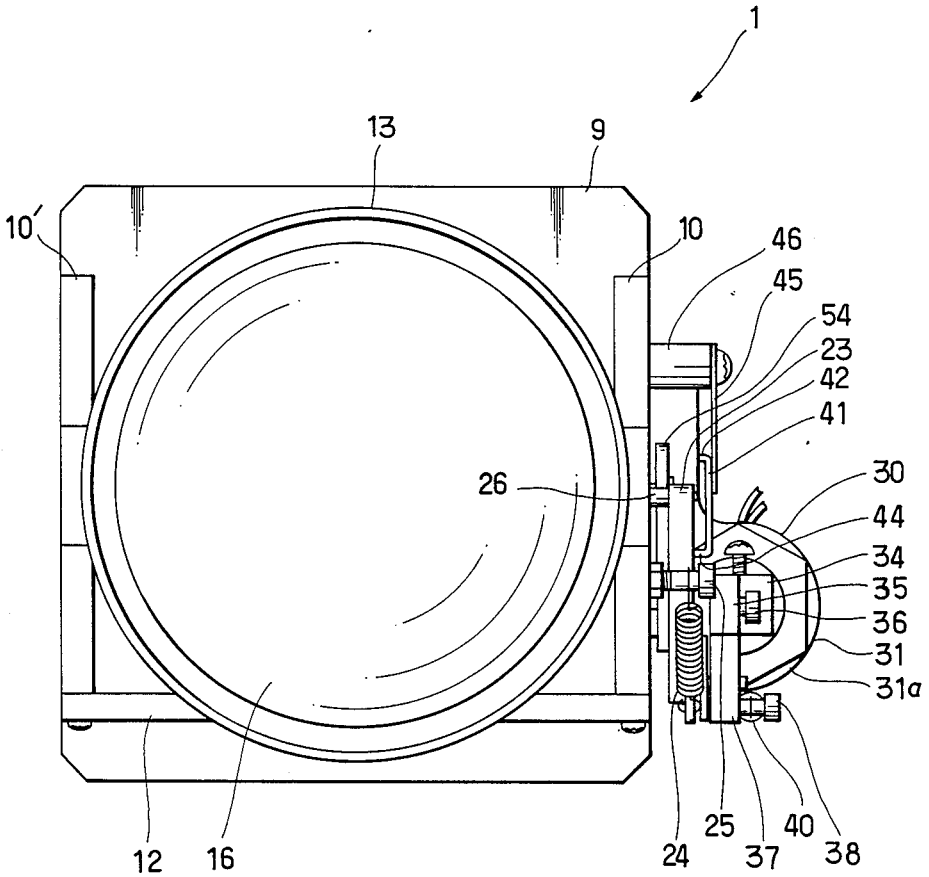
FIG. 5 is a front elevation of the headlamp unit.
Figure 6:
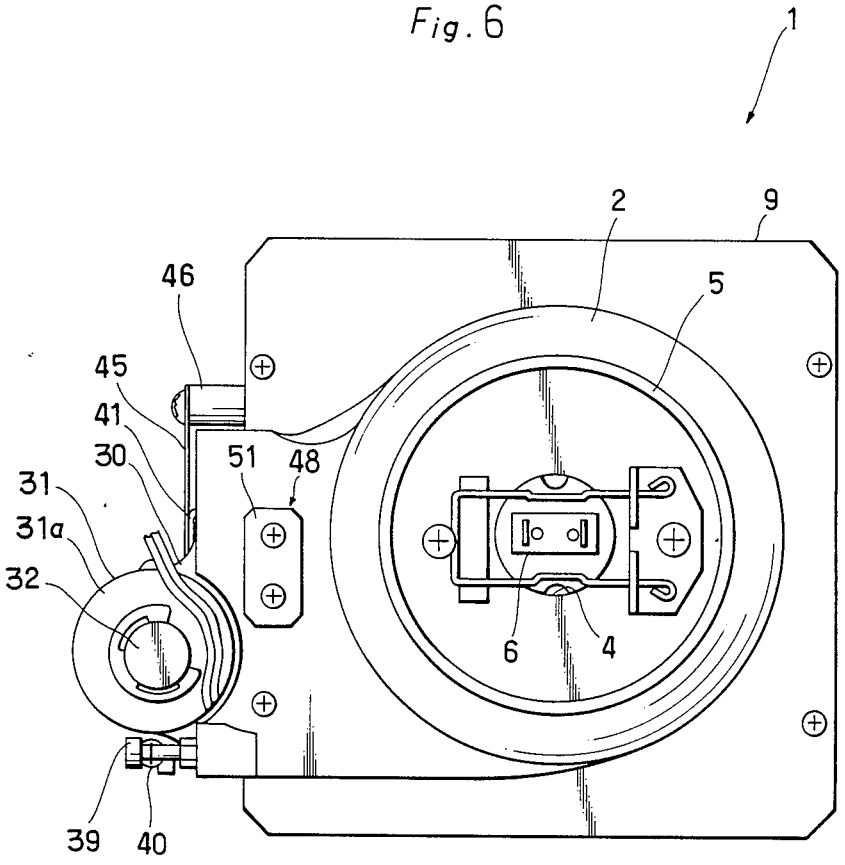
FIG. 6 is a rear elevation of the headlamp unit.

The right-hand one 14, as seen from the front side of the headlamp unit 1 as in FIG. 5, of the lens lugs 14 and 14' has a cam plate 20 of rectangular shape screwed or otherwise rigidly attached to its outer surface. FIGS. 1 and 3 indicate that the cam plate 20 is received with clearance in the opening 11 in the reflector lug 10. The cam plate 20 has an inverted V-shaped cam groove 21 defined in its outer surface which is exposed through the reflector lug opening 11.

A drive lever or bell crank 23 is pivoted at the apex of the angle formed by its two arms on the outer surface of the reflector lug 10 for angular displacement about an axis parallel to the axis of the trunnions 15. A helical tension spring 24 acts between a first or shorter arm of the bell crank 23 and a spring retainer pin 25 on the reflector lug 10, biasing the second or longer arm of the bell crank in a clockwise direction as viewed in FIGS. 1 and 3. The longer arm of the bell crank 25 has rigidly mounted to its distal end a pin 26 rotatably carrying a drive roller 27 which is in rolling engagement in the cam groove 21 in the cam plate 20.

Thus, with the oscillatory motion of the drive lever 23, the drive roller 27 will roll back and forth along the cam groove 21 thereby causing the bidirectional angular displacement of the converging lens 16 and shade 18 about the axis of the trunnions 15 and 15' relative to the reflector 2 and bulb 6. When the drive roller 27 is at the rear extremity **21*a* of the cam groove 21 as shown in FIGS. 1 and 3, the lens 16 and shade 18 are in a "lower beam " position, in which the optical axis of the lens 16 is in alignment with that of the reflector 2. When the drive roller 27 is positioned at or adjacent the apex 21*b* of the inverted-V-shaped cam groove 21, the lens 16 and shade 18 are in an "upper beam" position, with the optical axis of the lens 16 slightly angled upwardly as it extends forwardly of the headlamp unit 1. I will later discuss the two angular positions of the lens 16 and shade 18 in conjunction with the operation of the headlamp unit 1**.

In order to cause the bidirectional angular displacement of the drive lever 23, and hence of the lens frame 13 together with the converging lens 16 and shade 18 thereon, a solenoid 31 is bracketed at 30 to the reflector 2 so as to extend parallel to the reflector axis. This solenoid is to be energized for a predetermined brief period under the vehicle driver's control for conditioning the headlamp unit 1 for both upper and lower beam projection.

The solenoid 31 has a body **31*a* with a plunger 32 slidably mounted therein so as to be electromagnetically drawn forwardly into the body upon energization of the solenoid. On deenergization, then, the plunger 32 will be thrusted rearwardly of the body 31*a* by a spring, not shown, contained in the solenoid body 31*a*. The plunger 32 has a connecting rod 33 extending forwardly therefrom and embedded in a thickened base portion 34*a* of a generally L-shaped coupling member 34. Extending forwardly from the base portion 34*a*, a first arm 35 of the coupling member 34 has defined therein a slot 35*a* operatively receiving a pin 36 anchored to the longer arm of the bell crank 23. It is thus seen that the longitudinal displacement of the solenoid plunger 32 is translated into the angular diplacement of the drive lever 23 and hence of the lens frame 13. The coupling member 34 has a second arm 37 extending downwardly from its base portion 34*a* and firmly carrying a spring retainer 38. A helical tension spring 40 extends between this retainer 38 and another retainer 39 on the bracket 30, pulling the coupling member 34 toward the solenoid 31**.

Figure 2:
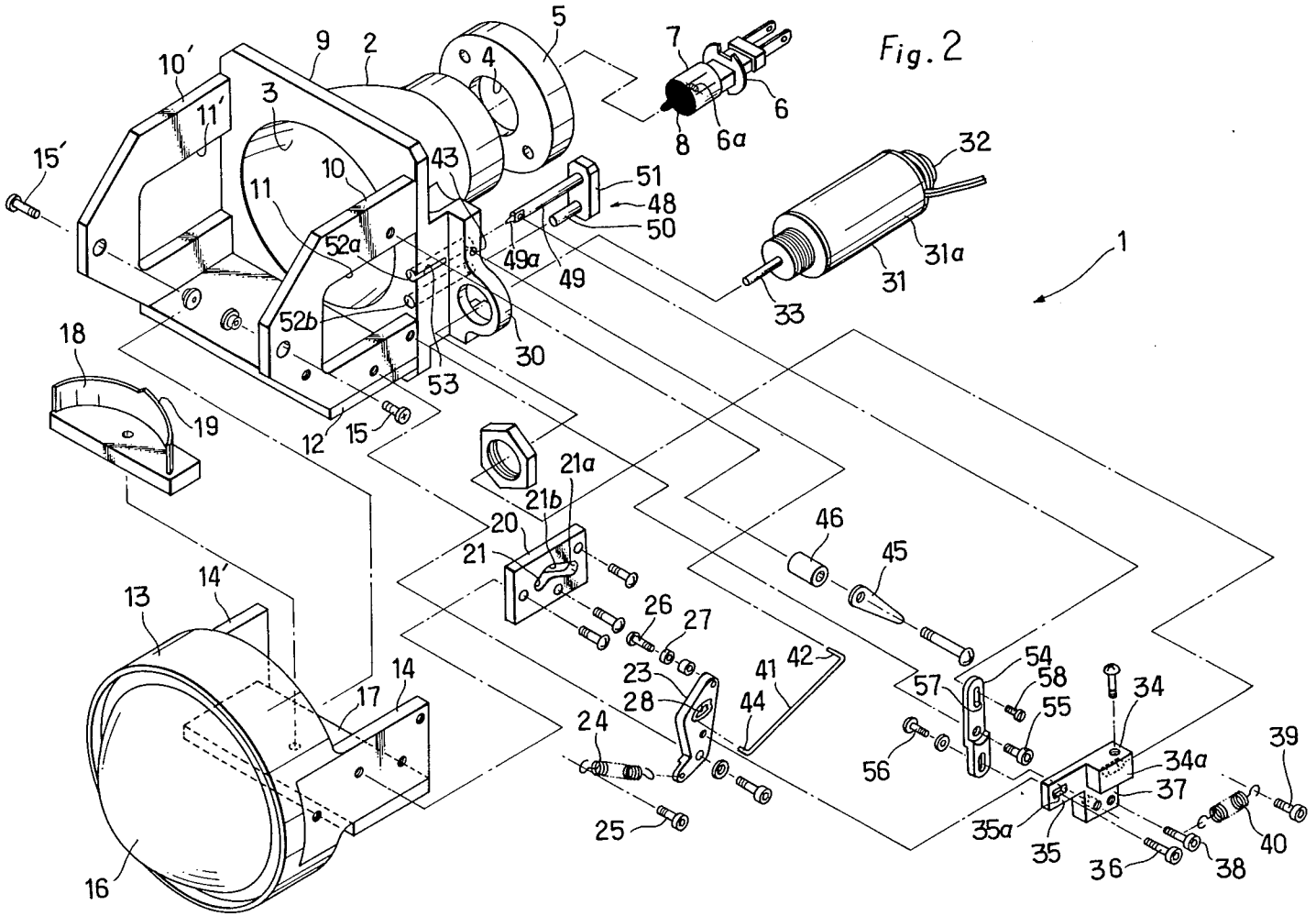
FIG. 2 is an exploded perspective view of the headlamp unit.

It will be observed from FIGS. 1–3 that the longer arm of the bell crank 23 has an endless groove or one-way slideway 28 formed in its surface directed away from the cam plate 20. Slidably engaged in the slideway 28 for endless one-way travel along the same is a slider 44 formed by right-angularly bending one end portion of a straight wire or rod constituting a drive lever stopper 41. As the name implies, the drive lever stopper 41 with its terminal slider 44 functions to stop the pivotal motion of the drive lever 23 in two preassigned angular positions alternately. The other end portion of the drive lever stopper 41 is likewise bent in the same direction as the slider 44 to provide a pivot 42 rotatably received in a hole 43 in the bracket 30, with the result that the drive lever stopper with the slider 44 is rotatable in a vertical plane parallel to the axis of the headlamp unit 1. A leaf spring 45 is cantilevered on a boss 46 on the reflector lug 10 and is held against the drive lever stopper 41 thereby resiliently holding its terminal slider 44 in sliding engagement in the slideway 28.

Figure 9A:
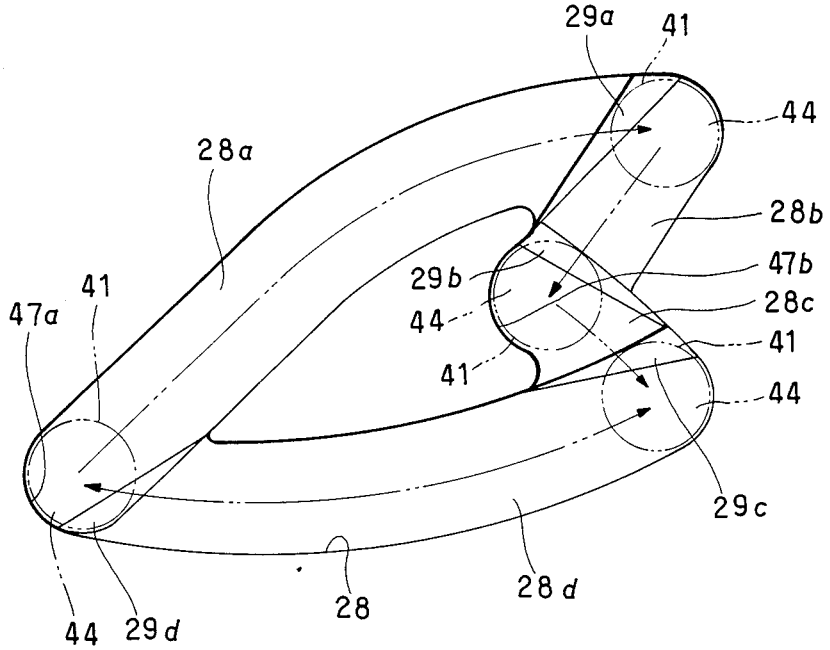
FIG. 9A is an enlarged elevation of a one-way slideway employed in the headlamp unit.

As illustrated on an enlarged scale in FIG. 9A, the endless slideway 28 as a whole is shaped like the conventionalized representation of a heart in recumbency. More specifically, the slideway 28 comprises a first portion **18*a* which extends approximately in the front-to-rear depth direction of the headlamp unit 1 and which is slightly convexed upwardly, a second portion 28*b* extending downwardly and forwardly from the rear extremity of the first portion 28*a* to an extent approximately one third of the length of the first portion, a third portion 28*c* of about the same length as the second portion 28*b* extending downwardly and rearwardly from the front or lower extremity of the second portion, and a fourth portion 28*d* which extends between the rear or lower extremity of the third portion 28*c* and the front extremity of the first portion 28*a*** and which is slightly convexed downwardly.

Figure 9B:
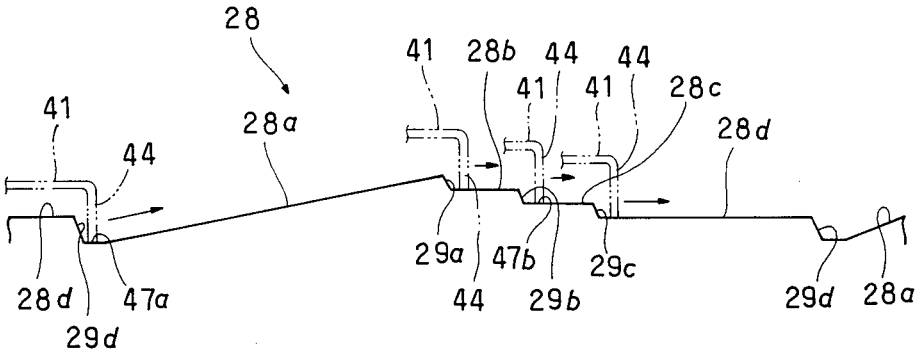
FIG. 9B is a developed representation of the one-way slideway, which is explanatory of the varying depth of the slideway.

I have illustrated in FIG. 9B the varying depth of the endless slideway 28 in developed form. This illustration presupposes that the slider 44 travels from the left to the right, that is, in the order of the slideway portions **28*a*, 28*b*, 28*c*, 28*d* and back to 28*a*. It will be noted, then, that each slideway portion becomes shallower as it extends in the direction of the slider travel, with a short, steep downward slope 29*a*, 29*b*, 29*c* or 29*d*** at the junction between any two successive portions.

Figure 10A:
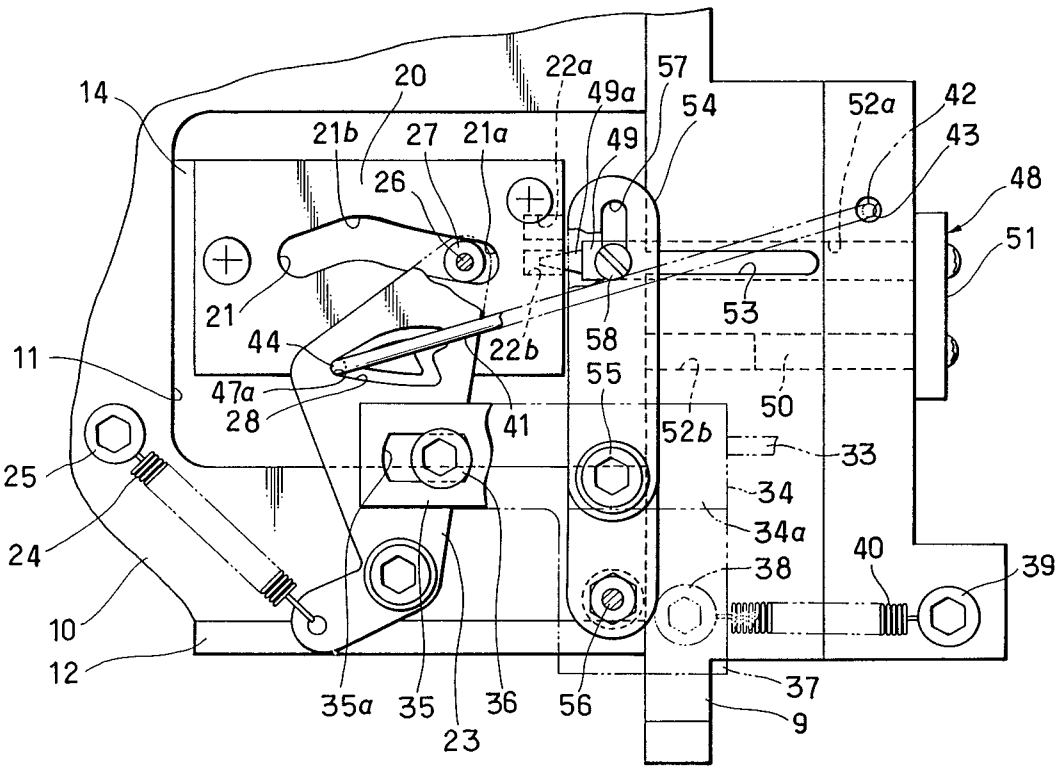
FIG. 10A is an enlarged, fragmentary side elevation, with parts shown broken away to reveal other parts, of the headlamp unit, the view showing in particular the lens frame drive means in the state when the lens frame is in the "lower beam" position.

A study of FIGS. 10A–10D will make clear how the slider 44 endlessly travels along the one-way slideway 28 with the oscillatory motion of the drive lever 23. FIG. 10A shows the slider 44 positioned at the junction **47*a* between the first 28*a* and fourth 28*d* slideway portions, and the drive lever roller 27 positioned at the rear or right-hand extremity 21*a* of the cam groove 21. When the drive lever 27 is pivoted counterclockwise from its FIG. 10A position to that of FIG. 10B upon energization of the solenoid 31, the slider 44 will travel rearwardly along the first slideway portion 28*a* and, sliding down the steep slope 29*a*, reach the junction between the first 28*a* and second 28*b* slideway portions. As will be understood by referring again to FIG. 9B, the steep slope 29*d* functions to prevent the slider 44** from traveling rearwardly along the second slideway portion 28d from the junction 47a.

Figure 10B:
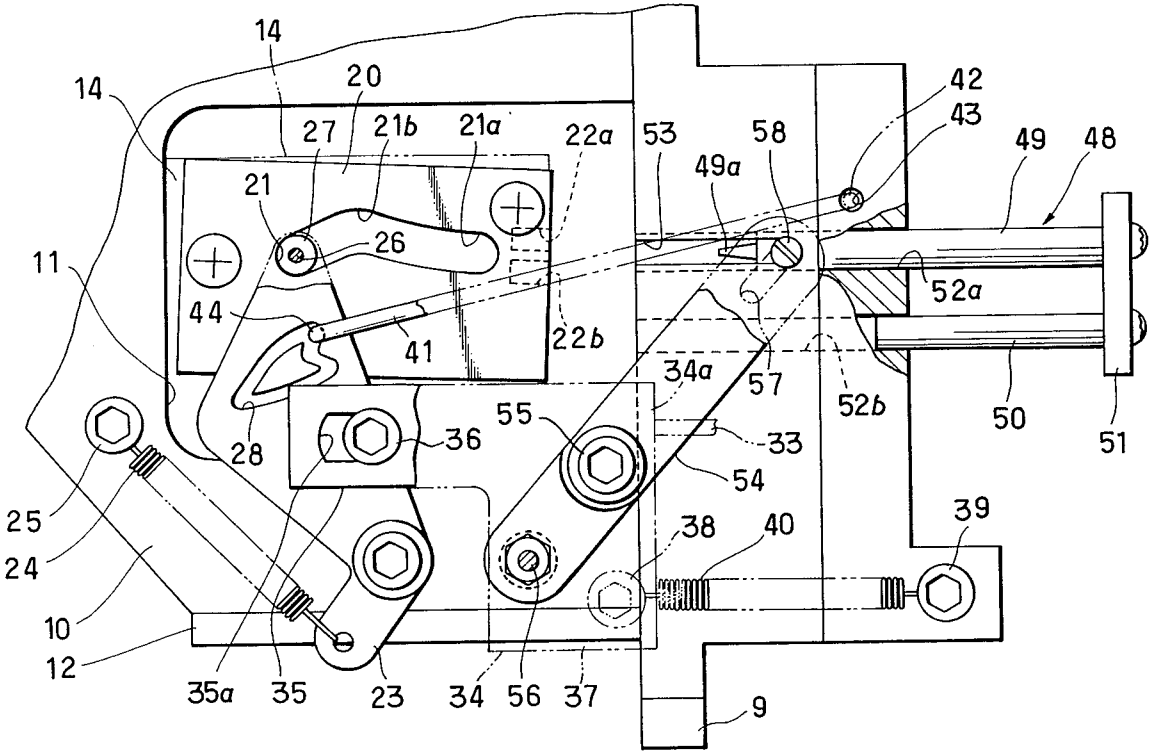
FIG. 10B is a view similar to FIG. 10A except that the lens frame drive means are shown in a state of transition from the "lower beam" to "upper beam" position.

Then, upon deenergization of the solenoid 31, the drive lever 23 will start pivoting clockwise from its FIG. 10B position under the bias of the tension spring 24. The slider 44 will then travel down the second slideway portion 28b as indicated by the arrow in FIG. 9A and, sliding down the steep slope 29b, will reach the junction 47b between the second 28b and third 28c slideway portions as in FIG. 10C. When the slider 44 reaches this junction 47b, the drive lever stopper 41 will arrest the clockwise turn of the drive lever 23 against the force of the tension spring 24, holding the drive lever roller 27 at the apex 21b of the cam groove 21, as shown also in FIG. 10C. The steep slope 29a will prevent the slider 44 from moving back along the first slideway portion 28a from the junction between the first and second slideway portions 28a and 28b.

When the drive lever 23 is subsequently pivoted counterclockwide from its FIG. 10C position to that of FIG. 10D by the energization of the solenoid 31, the slider 44 will slide down the third slideway portion 28c as indicated by the arrow in FIG. 9A and, sliding down the steep slope 29c, will reach the junction between the third 28c and fourth 28d slideway portions. The steep slope 29b will prevent the slider 44 from traveling back along the second slideway portion 28b from the junction between the second and third slideway portions 28b and 28c.

Figure 10C:
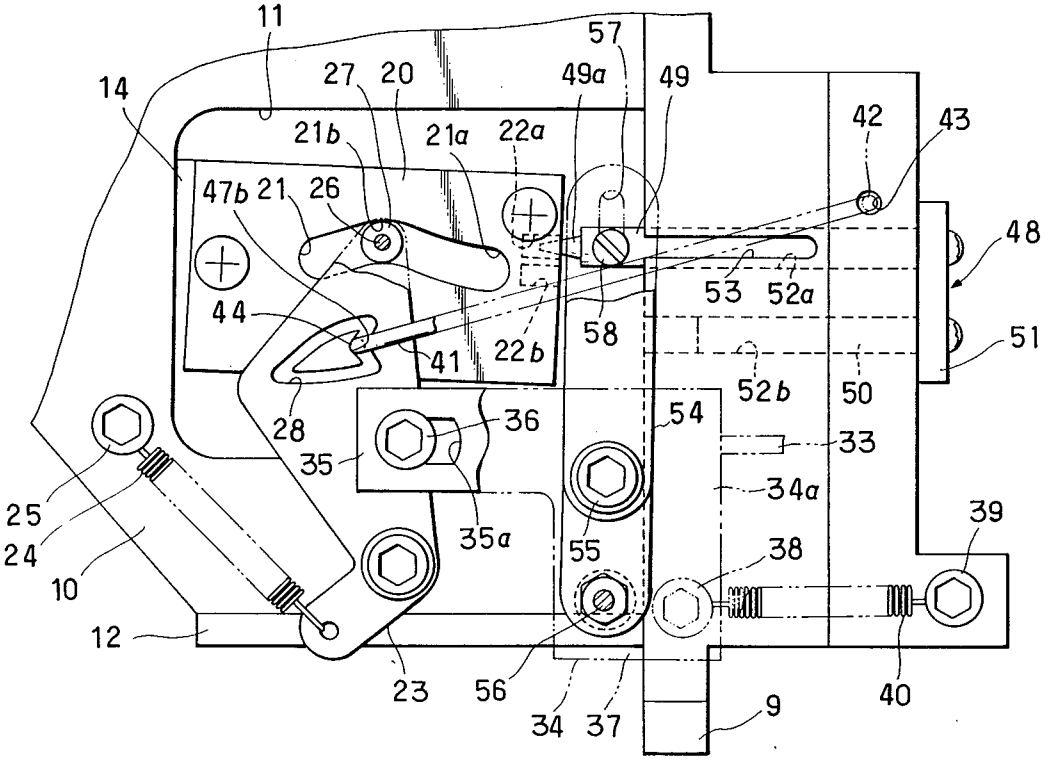
FIG. 10C is also a view similar to FIG. 10A except that the lens frame drive means are shown in the state when the lens frame is in the "upper beam" position.
Figure 10D:
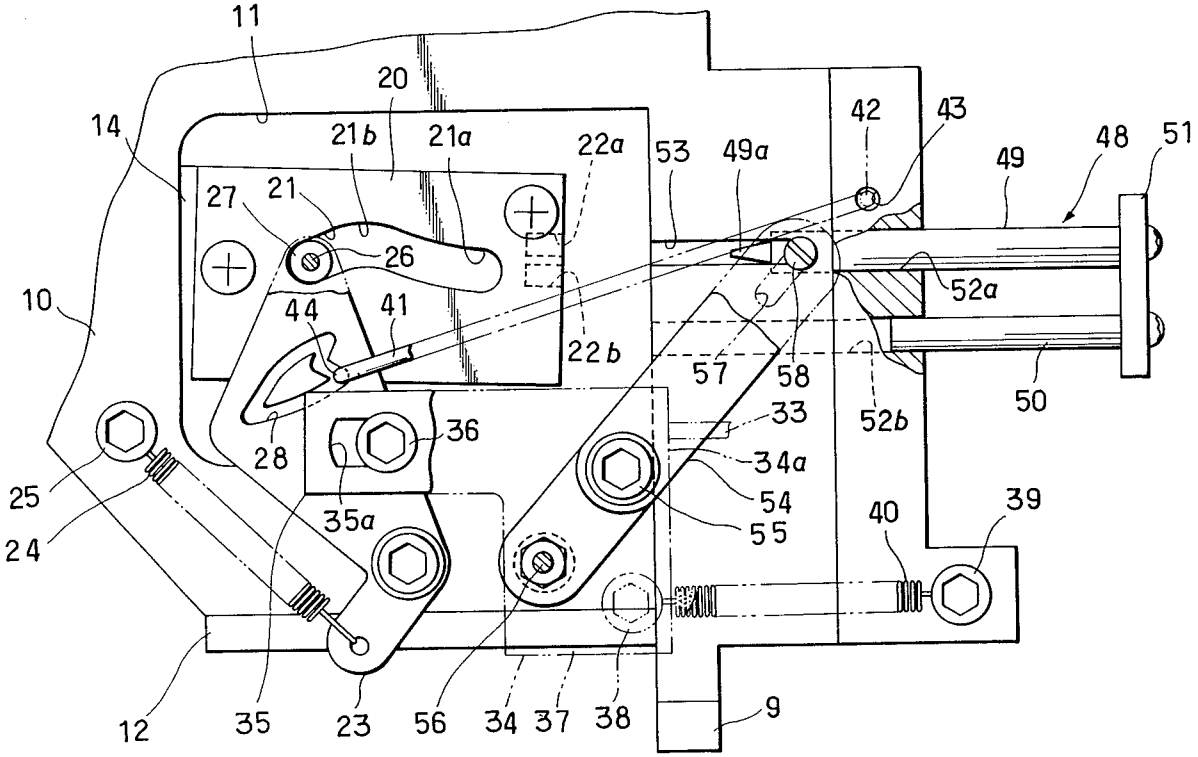
FIG. 10D is also a view similar to FIG. 10A except that the lens frame drive means are shown in a state of transition from the "upper beam" to "lower beam" position.

Then, upon deenergization of the solenoid 31, the drive lever 23 will pivot clockwise from its FIG. 10D position under the force of the tension spring 24. The slider 44 will then travel forwardly along the fourth slideway portion 28d and, sliding down the steep slope 29d, will return to the junction 47a between the first 28a and fourth 28d slideway portions when the drive lever roller 27 reaches the rear extremity 21a of the cam groove 21, as seen in FIG. 10a. The steep slope 29c will prevent the slider 44 from traveling back along the third slideway portion 28c from the junction between the third and fourth slideway portions 28c and 28d.

The converging lens 16 and lower-beam shade 18 are in the "lower beam" position when the drive lever stopper 41 locks the drive lever 23 in the FIG. 10A position, and are in the "upper beam" position when the drive lever stopper 41 locks the drive lever 23 in the FIG. 10C position.

Figure 11A:
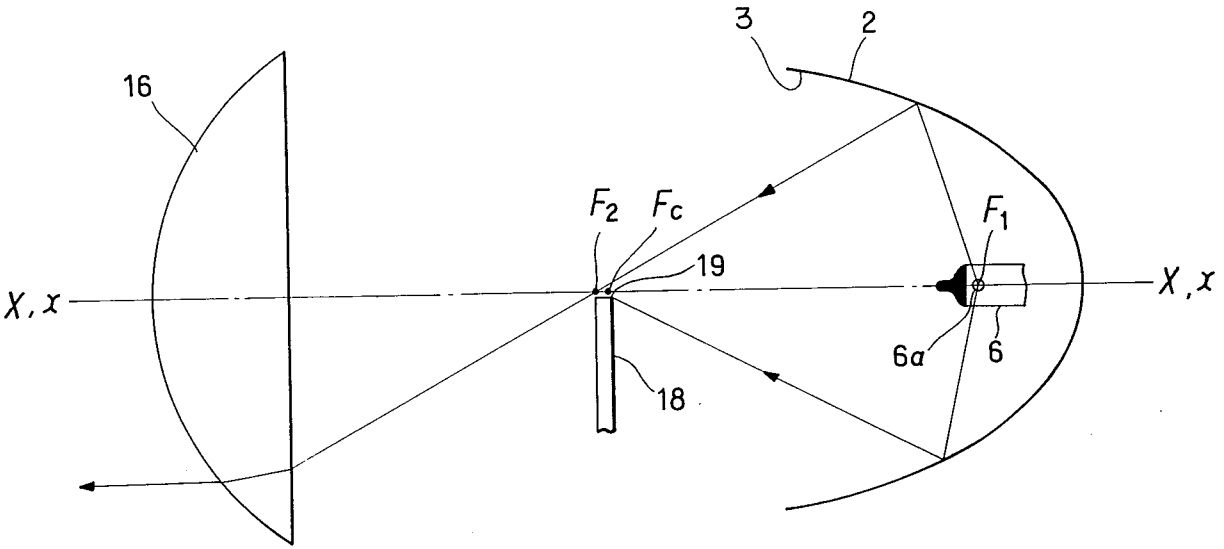
FIG. 11A is a diagrammatic representation of the optical system of the headlamp unit as conditioned for lower beam projection.
Figure 11B:
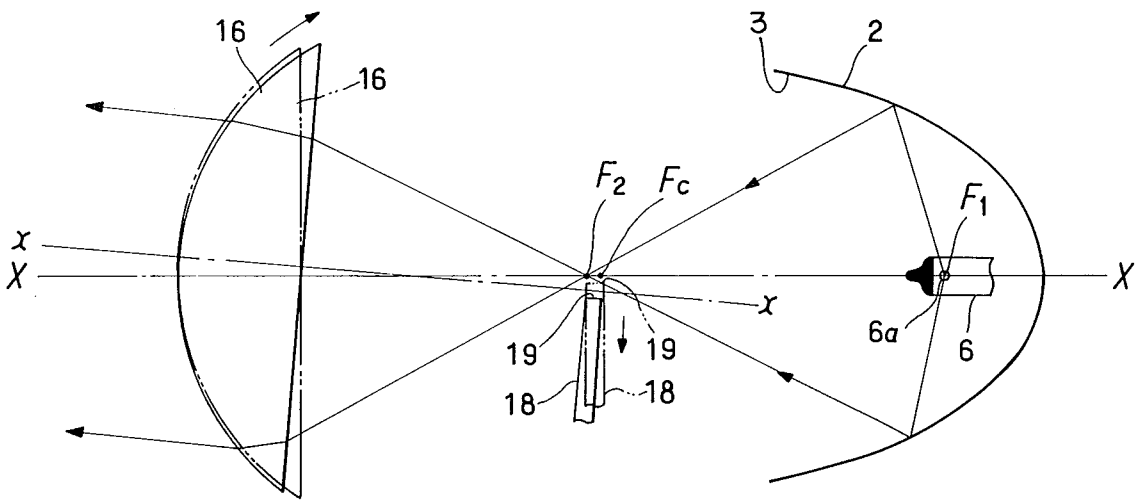
FIG. 11B is also a diagrammatic representation of the optical system as conditioned for upper beam projection.

FIGS. 11A and 11B are diagrammatic illustrations of the optical system of the headlamp unit 1 when the lens 16 and shade 18 are in the "lower beam" and "upper beam" positions, respectively. It will be seen from these illustrations that the single filament 6a of the bulb 6 is disposed at the first focus F1 of the ellipsoidal reflector 2. Emitted by the filament 6a, the rays of light will be reflected by the reflector 2 so as to converge at its second focus F2 spaced forwardly from the first focus F1.

When in the "lower beam" position as in FIG. 11A, the converging lens 16 has its x—x in alignment with the axis X—X of the reflector 2. The lens 16 has a focus Fc slightly displaced rearwardly of the second focus F2 of the reflector 2. The contoured top edge 19 of the lower-beam shade 18 is disposed very close to the second focus F2 of the reflector 2 for cutting off the rays reflected from approximately the lower half of the reflective surface 3.

When the lens 16 and shade 18 are moved to the "upper beam" position as in FIG. 11B, the axis x—x of the lens 16 becomes slightly angled upwardly as it extends forwardly of the headlamp unit 1, whereas the shade 18 becomes displaced downwardly from the fixed axis X—X of the reflector 2, typically by the order of several millimeters.

As will be best understood from FIGS. 2 and 10A–10D, the headlamp unit 1 further comprises a lens frame latch assembly 48 for positively retaining the lens frame 13, and therefore the lens 16 and shade 18, in the "upper beam" or "lower beam" positions. The latch assembly 48 includes a flat base 51 disposed behind the bracket 30. Extending forwardly from the base 51 with a vertical spacing are a latch 49 terminating in a conical tip 49a and a shorter guide pin 50. The latch 49 and guide pin 50 are slidably received in holes 52a and 52b, respectively, extending through the bracket 30 and reflector flange 9. The upper hole 52a receiving the latch 49 is laterally open through a slot 53 extending rearwardly from the front end of the hole 52a to an extent approximately half the length of the hole. The tip 49a of the latch 49 further extends forwardly from the hole 52a for selective engagement in two cavities 22a and 22b which are formed with a vertical spacing in the rear end of the cam plate 20 secured to the lens lug 14'. The guide pin 50 serves the purpose of guiding such longitudinal movement of the latch 49 without angular displacement.

When the cam plate 20 is in the "lower beam" position as in FIG. 10A, the tip 49a of the latch 49 is engaged in the lower cavity 22b thereby positively holding the lens frame 13 in the required angular position about the axis of the trunnions 15 and 15' with respect the reflector 2. On the other hand, when the cam plate 20 is in the "upper beam" position as in FIG. 10C, the latch tip 49a is engaged in the upper cavity 22a thereby positively retaining the lens frame 13 in the corresponding angular position with respect to the reflector 2. The latch tip 49a is of course out of engagement with either of the cavities 22a and 22b during the angular displacement of the lens frame 13 between the two positions.

For such longitudinal displacement of the latch 49 in step with the angular displacement of the lens frame 13, a link 54 is connected between the latch and the coupling member 34. The link 54 is medially pivoted at 55 on the reflector lug 10. One end of the link 54 is operatively pinned at 56 to the second arm 37 of the coupling member 34 so that the link bidirectionally rotates in a vertical plane about the pivot 55 with the linear reciprocation of the coupling member. Slidably extending through a slot 57 in the other end portion of the link 54, a headed pin 58 is firmly planted on the latch 49 through the slot 53 in the reflector flange 9.

When, with the solenoid 31 unenergized, the coupling member 34 is in its retracted or rearward position as in FIG. 10A or 10C, the tip 49a of the latch 49 is engaged either in the cavity 22b in the cam plate 20 as in FIG. 10A or in the other cavity 22a therein as in FIG. 10C. The lens frame 13 together with the lens 16 and shade 18 thereon is then positively locked in the "high beam" or "low beam" position with respect to the reflector 2.

Upon energization of the solenoid 31 the coupling member 34 will travel forwardly as in FIG. 10B or 10D thereby causing the link 54 to turn in a clockwise direction, as seen in these figures, about its pivot 55. Sliding along the slot 57 in the link 54, the headed pin 58 will translate the clockwise turn of the link into the linear rearward movement of the latch 49, and therefore of the complete latch assembly 48, with respect to the reflector 2, resulting in the disengagement of the latch tip 49*a* from either of the cavities 22*a* and 22*b* in the cam plate 20. The link 54 will be pivoted in a counterclockwise direction upon subsequent deenergization of the solenoid 31 with the rearward travel of the coupling member 34. Then the latch tip 49*a* will be re-engaged in either of the cavities 22*a* and 22*b* for locking the lens frame 13 in the required angular position.

OPERATION

The single-filament headlamp unit 1 of the foregoing construction permits switching between high and low beam projection with each brief energization of the solenoid 31. Such switching takes place as set forth hereafter.

I have drawn FIG. 10A on the assumption that the headlamp unit 1 is throwing a lower beam, with its optical system in the state of FIG. 11A. The drive lever 23 is fully turned clockwise, as seen in FIG. 10A, with the drive roller 27 on its distal end positioned at the rear or right hand extremity 21*a* of the cam groove 21 in the cam plate 20. The slider 44 at one end of the drive lever stopper 41 is positioned at the junction 47*a* between the first 28*a* and fourth 28*d* portions of the one-way slideway 28 on the drive lever 23. The tip 49*a* of the latch 49 is engaged in the lower cavity 22*b* in the cam plate 20, latching the lens frame 13 in the "lower beam" position.

Figure 12A:
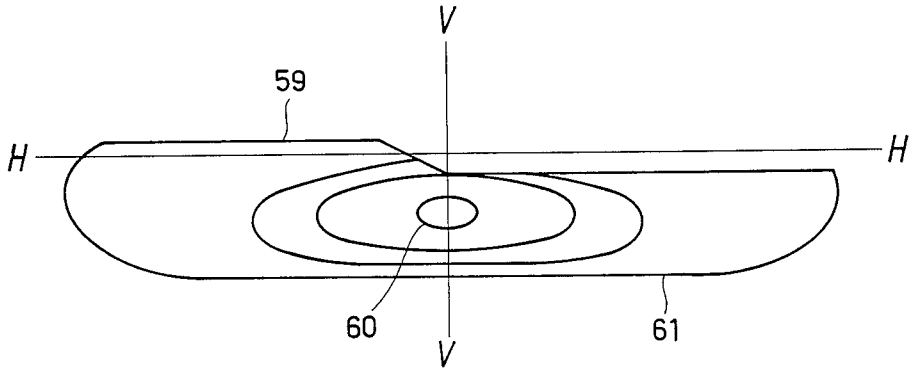
FIG. 12A is a diagrammatic representation of the lower beam pattern according to the headlamp unit of FIG. 1.

With the lens frame 13 thus retained in the "lower beam" position, the optical axis X—X of the reflector 2 is in alignment with the optical axis x—x of the converging lens 16, as drawn in FIG. 11A. Further, as depicted in the same figure, the contoured edge 19 of the lower beam shade 18 lies sufficiently close to the second focus F2 of the reflector 2 for cutting off the rays that have been reflected from approximately the bottom half of the reflector surface 3. FIG. 12A indicates at 61 the resulting lower beam pattern. The contoured edge 19 of the shade 18 determines the top edge 59 of the lower beam pattern 61. Also, as is per se conventional in the art, the hot zone 60 of the lower beam is located below the horizontal plane H—H passing the center of the headlamp unit 1.

The solenoid 31 must be energized for a change from the lower to the upper beam, as by the actuation of a beam select switch, not shown, included in the electric power circuitry associated with the solenoid. I understand that the solenoid is energized only for a predetermined brief time following the actuation of the beam select switch.

Thus, upon subsequent energization of the solenoid 31, the coupling member 34 will be thereby thrusted forwardly against the force of the tension spring 40 for turning the link 54 in a clockwise direction from its FIG. 10A position toward that of FIG. 10B. The latch 49 will then travel rearwardly out of engagement in the lower cavity 11*b* in the cam plate 20 for unlatching the lens frame 13. Further, as the coupling member 34 pushes the pin 36 forwardly, the drive lever 23 will turn in a counterclockwise direction against the bias of the tension spring 24. During such counterclockwise turn of the drive lever 23 the drive roller 27 on its distal end will travel along the cam groove 21 from its rear to front extremity, whereas the slider 44 on the distal end of the drive lever stopper 41 will slide along the first portion 28*a* of the slideway 28 to its junction with the second slideway portion 28*b*, as shown also in FIG. 10B. Although the converging lens 16 is now tilted upwardly, the lens frame 13 still remains unlatched.

The solenoid 31 will be deenergized upon lapse of the preassigned time. Upon consequent retraction of the coupling member 34 under the bias of the tension spring 40, and clockwise turn of the drive lever 23 under the bias of the tension spring 24, the slider 44 will immediately become locked at the junction 47*b* between the second 28*b* and third 28*c* slideway portions, arresting the clockwise turn of the drive lever in the FIG. 10C position. The drive roller 27 on the distal end of the drive lever 23 is now located at the apex 21*b* of the cam groove 21, with the result that the converging lens 16 remains tilting upwardly. The coupling member 34, however, will retract to its most rearward position since its arm 35 is coupled to the drive lever 23 via the pin 36 slidably engaged in the slot 35*a*. Upon such full retraction of the coupling member 34 the link 54 will turn counterclockwise from its FIG. 10B position to that of FIG. 10C thereby moving the latch 49 into engagement in the upper cavity 22*a* in the cam plate 20. Now the lens frame 13 has been latched in the "upper beam" position.

Figure 12B:
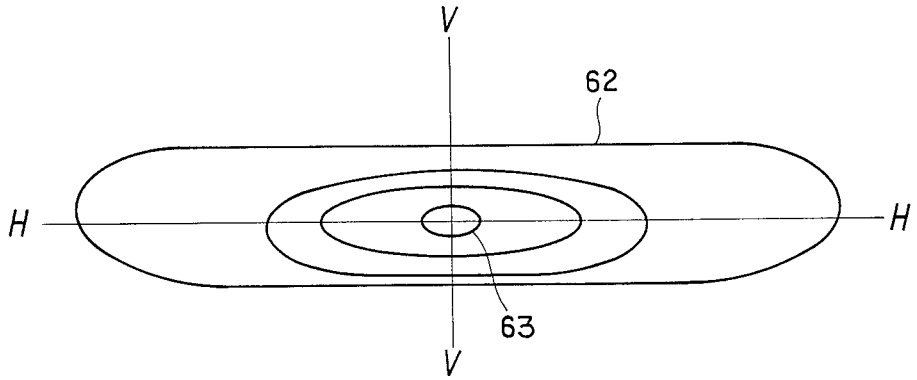
FIG. 12B is a diagrammatic representation of the upper beam pattern according to the headlamp unit of FIG. 1.

I have shown the resulting "upper beam" configuration of the optical system in FIG. 11B and the upper beam pattern in FIG. 12B. It will be noted from FIG. 11B that the lower beam shade 18 is now spaced some distance (several millimeters) below the second focus F2 of the reflector 2. So displaced downwardly, the shade 18 permits all, or nearly all, of the rays that have been reflected by the reflector 2, to travel therepast. The converging lens 16 is also slightly angled upwardly, throwing an upper beam that is patterned as indicated at 62 in FIG. 12B. It should be appreciated that the hot zone of this upper beam pattern is located at the intersection of the horizontal line H—H and vertical line V—V, which fact is a highly favorable attibute of upper beams to be thrown by vehicular headlamps.

The solenoid 31 may be reenergized for lowering the beam emitted by the headlamp unit 1. The reenergization of the solenoid 31 will result, first of all, in the withdrawal of the latch tip 49*a* out of the upper cavity 22A in the cam plate 20 and, consequently, in the unlatching of the lens frame 13. Also, as the coupling member 34 pushes the pin 36 forwardly, the drive lever 23 will turn counterclockwise from its FIG. 10C position to that of FIG. 10D, in which latter position the drive roller 27 will be positioned at the front extremity of the cam groove 21. During such clockwise turn of the drive lever 23 the slider 44 will slide down the third portion 28*c* of the endless slideway 28 on the drive lever 23 to the junction between the third 28*c* and fourth 28*d* slideway portions.

Upon subsequent deenergization of the solenoid 31 with the lapse of the predefined excitation period, the drive lever 23 will turn clockwise from its FIG. 10D position back to that of FIG. 10A under the bias of the tension spring 24. The lens frame 13 will then be pivoted back to the "lower beam" position. At the same time the slider 44 will slide along the fourth slideway portion 28*d* back to its junction 47*a* with the first slideway portion 28*a*. Further the latch 49 will be thrusted forwardly into reengagement in the lower cavity 22*b* in the cam plate 20 thereby latching the lens frame 13 in the "lower beam" position. The headlamp unit 1 has now been reconditioned for lower beam projection.

ALTERNATIVE FORM

Figure 13:
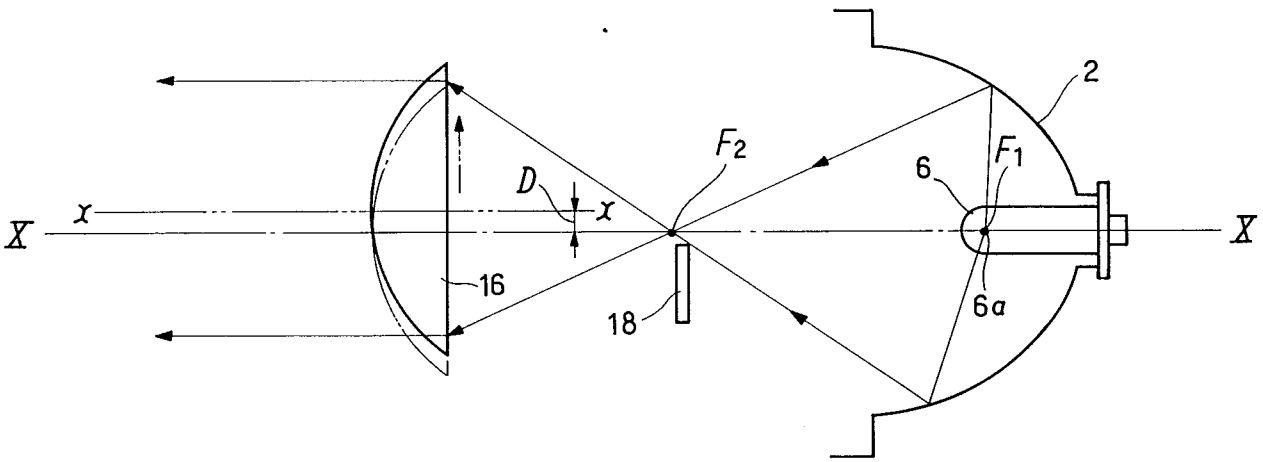
FIG. 13 is a diagrammatic representation of the optical system of an alternative form of headlamp unit in accordance with the invention.

In an alternative form of headlamp unit shown diagrammatically in FIG. 13, only the converging lens 16 is made movable substantially vertically between the phantom "lower beam" position and the solid-line "upper beam" position. The distance D between the two positions may be approximately 1.5 millimeters. The axis x—x of the lens 16 is aligned with the axis X—X of the reflector 2 when the lens is in the "lower beam" position, and is shown to be parallel to the reflector axis when the lens is in the "upper beam" position. The shade 18 is immovably disposed in the "lower beam" position of its counterpart in the preceding embodiment, as will be seen by referring back to FIG. 11A, although of course the shade may be displaced downwardly in step with the upward displacement of the lens 16.

The alternative headlamp unit emits a lower beam when the lens 16 is in the "lower beam" position, just as has been explained with reference to FIG. 11A in conjunction with the previously disclosed embodiment. Upon upward displacement of the lens 16 to the "upper beam" position, nearly all of the rays that have been reflected by the reflector 2 will impinge on the lens despite the unvarying position of the shade 18. The hot zone of the upper beam will be higher than that of the lower beam because of the upward displacement of the lens 16.

Despite the foregoing detailed disclosure I do not wish my invention to be limited by the exact details of the illustrated embodiments. Thus, for example, the ellipsoidal reflector employed in the foregoing embodiments may be replaced by other types of reflectors capable of convergently reflecting rays in essentially the same manner. Additional modifications or alterations may be resorted to without departing from the scope of the invention.

What I claim is:

1. An electric lamp unit for particular use as a vehicular headlamp capable of selectively throwing upper and lower beams, comprising:

(a) a reflector having an optical axis extending horizontally, a first focus, and a second focus disposed farther away from the reflector than is the first focus;

(b) a light source disposed at the first focus of the reflector, the reflector being capable of reflecting rays of light from the source so as to converge at the second focus thereof;

(c) a shade disposed adjacent the second focus of the reflector;

(d) a converging lens disposed opposite the reflector and having a focus in the vicinity of the shade;

(e) means for selectively and pivotally moving both the converging lens and the shade in fixed relation relative to the reflector between a "lower beam" position in which an optical axis of the converging lens is aligned with the optical axis of the reflector and in which the shade is placed adjacent the second focus thereby to permit the rays that have been reflected from approximately an upper half of the reflector to impinge on the converging lens, and an "upper beam" position which is disposed upwardly from the "lower beam" position and in which the shade is placed downward away from the adjacency of the second focus thereby to permit substantially all the rays that have been reflected from the reflector to impinge on the converging lens.

2. The electric lamp unit of claim 1 wherein the shade is disposed adjacent the second focus of the reflector only when the converging lens is in the "lower beam" position, and is moved downwardly from the adjacency of the second focus of the reflector when the converging lens is moved to the "upper beam" position.

3. An electric lamp unit as claimed in claim 1, in which said means comprises:

a lens frame supporting the converging lens and the shade in fixed relation to each other and pivotally coupled to the reflector for angular displacement about a horizontal axis which is at right angles with the optical axis of the reflector as seen vertically and which is disposed intermediate the converging lens and the shade; and drive means for pivoting the lens frame relative to the reflector between the "lower beam" position and the "upper beam" position.

4. The electric lamp unit of claim 3 wherein the drive means comprises:

(a) a cam on the lens frame;

(b) a reflector frame in fixed relation to the reflector;

(c) a drive lever pivotally mounted to the reflector frame and operatively engaged with the cam; and (d) a linear actuator mounted to the reflector frame and coupled to the drive lever for bidirectionally pivoting the same, the drive lever on being pivoted by the linear actuator coacting with the cam for pivoting the lens frame between the "upper beam" and "lower beam" positions.

5. The electric lamp unit of claim 4 wherein the linear actuator is a solenoid, and wherein the drive means further comprises stopper means acting on the drive lever for alternately stopping the pivotal motion of the lens frame in the "upper beam" and "lower beam" positions each time the solenoid is actuated for a preassigned time.

6. The electric lamp unit of claim 4 further comprising means for positively locking the lens frame in the "upper beam" and "lower beam" positions.

7. The electric lamp unit of claim 5 wherein the drive lever has an endless one-way slideway defined therein, and wherein the stopper means comprises a drive lever stopper having a first end pivoted on the reflector frame and a second end slidably engaged in the slideway.

* * * * *